US009064648B2

(12) United States Patent
Rival et al.

(10) Patent No.: US 9,064,648 B2
(45) Date of Patent: Jun. 23, 2015

(54) VALVE SYSTEM FOR AN ARC EXTINGUISHING CHAMBER AND CIRCUIT BREAKER COMPRISING SAME

(75) Inventors: Marc Rival, Saint Ismier (FR); Steeve Becker, Grenoble (FR); Clinton Carne, North Liberty, IA (US); Thierry Berzin, Grenoble (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 498 days.

(21) Appl. No.: 13/064,938

(22) Filed: Apr. 27, 2011

(65) Prior Publication Data

US 2011/0259852 A1 Oct. 27, 2011

(30) Foreign Application Priority Data

Apr. 27, 2010 (FR) ..... 10 01790

(51) Int. Cl.
*H01H 9/34* (2006.01)

(52) U.S. Cl.
CPC ..... *H01H 9/342* (2013.01); *H01H 2009/343* (2013.01)

(58) Field of Classification Search
CPC ..... H01H 9/34; H01H 9/342; H01H 9/346
USPC ..... 218/147–149, 150–158, 15, 34, 35; 335/201, 202
See application file for complete search history.

(56) References Cited

U.S. PATENT DOCUMENTS

| | | | | | |
|---|---|---|---|---|---|
| 2,839,641 | A | | 6/1958 | Edmunds | 200/144 |
| 3,582,966 | A | * | 6/1971 | Strobel | 218/149 |
| 4,075,446 | A | * | 2/1978 | Aadahl | 218/155 |
| 4,631,376 | A | | 12/1986 | Leone | 200/306 |
| 4,672,157 | A | | 6/1987 | Neel et al. | 200/144 R |
| 5,753,878 | A | | 5/1998 | Doughty et al. | 218/157 |
| 5,811,749 | A | * | 9/1998 | Bausch et al. | 218/157 |
| 5,889,249 | A | | 3/1999 | Rival et al. | 218/149 |
| 6,218,636 | B1 | | 4/2001 | Blancfene et al. | 218/158 |
| 6,222,147 | B1 | | 4/2001 | Doughty et al. | 218/157 |
| 6,670,872 | B2 | | 12/2003 | Kurzmann | 335/201 |
| 6,703,576 | B1 | | 3/2004 | Chou et al. | 218/157 |
| 7,176,771 | B2 | | 2/2007 | Faber et al. | 335/201 |

FOREIGN PATENT DOCUMENTS

| | | |
|---|---|---|
| EP | 0 206 882 | 12/1986 |
| FR | 2 750 531 | 1/1998 |
| FR | 2 788 372 | 7/2000 |
| WO | WO 01/67475 | 9/2001 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

A closing system for an arc extinguishing chamber of a circuit breaker with high breaking capacity has been developed. The system according to the invention comprises a first duct equipped with a set of filters able to support usual pressures caused by the gases arising from the switching arc, in particular about 10 to 12 bars, and a second duct closed by a valve device enabling direct outlet of the exhaust gases when the pressure exceeds a threshold so as to prevent any explosion of the case. The outer wall of the extinguishing chamber is designed for the circuit breaker housing so as, including in case of opening of the valve device, to direct the gases and to prevent any arc-over on the frame. The valve device comprises a suitable membrane made from polymer, in particular aramide.

20 Claims, 3 Drawing Sheets

VALVE SYSTEM FOR AN ARC EXTINGUISHING CHAMBER AND CIRCUIT BREAKER COMPRISING SAME

BACKGROUND OF THE INVENTION

The invention relates to arc extinguishing chambers of electrical protection equipment of circuit breaker type with high breaking capacity. More generally, the invention relates to a closing system enabling the gases generated by an electric arc to be cooled and filtered, but enabling said gases to be removed in differentiated manner according to the importance of the fault and to the excess pressure thus generated.

STATE OF THE ART

Low-voltage circuit breakers having high ratings generally comprise separable contacts arranged at the entry of an arc extinguishing chamber. When separation of the contacts takes place in response to a trip device following an overcurrent, an electric arc arises between the contacts and propagates into the arc chamber designed to absorb the energy of the arc while maintaining the arcing voltage. The arc chamber comprises a plurality of separators arranged transversely to the arc and designed to break the arc down into fractions. This fractioning enables the voltage of the arc to be increased and the arc to be cooled by heat exchange with the separators which are supported by two side walls of the arc chamber arranged facing one another perpendicularly to the separators.

The arc chamber is subjected to very high thermal, mechanical and electrical stresses. A current of as much as 200 kA maintained for 4 ms at an arcing voltage of 500 V thus gives off an energy of 400 kJ, the plasma column forming the arc is able to reach a temperature situated between 3500 and 20,000° C. and the pressure in the arc chute chamber can simultaneously reach 1.4 MPa. The overpressure generated is transmitted to the circuit breaker case and different means have been implemented to cope with this stress.

One solution consists in providing valves for removal of exhaust gases, as described for example in EP 0 206 882, WO 01/67475, U.S. Pat. No. 5,753,878 or U.S. Pat. No. 6,703,576. Document U.S. Pat. No. 6,670,872 provides for a prior increase of the internal volume with a damper bellows releasing an exhaust vent after extension. These means prevent the circuit breaker case from exploding. However, once they have been released, the ionized gases can direct themselves towards the live connection parts of the circuit breaker, which can generate a possible arc-over on the frame. The heat of the gases originating from the arc furthermore results in an increased risk for the operator in the event of a short-circuit.

To circumvent this problem, some circuit breakers present filtering systems enabling the gases generated by the arc to be cooled and deionized so as to guarantee a secured external environment. The filtering system, as for example described in U.S. Pat. No. 7,176,771 or FR 2 788 372, conventionally comprises chicanes and tightly sealed ducts to force the gases to flow therein. As a corollary, sealing means retain the gases inside the case so long as filtering has not been performed. Circuit breakers having extreme performances may however see the residual pressure inside their case become very high. For example, for a circuit breaker displaying a three-phase performance of 200 kA 508 V, a single-phase performance of 174 kA 508V is required by ANSI standards, and the pressure generated can be more than 14 bars. It is however difficult for filtering systems to withstand pressures in excess of 14 bars with, in addition to possible explosion of the case, breaking or tearing of the sealing gaskets, which implies non-controlled flow of the gases and therefore a hazard for an operator and a risk of arc-over.

SUMMARY OF THE INVENTION

Among other advantages, the object of the invention is to palliate the shortcomings of existing arc extinguishing chambers. In particular the invention proposes to maintain a filtering duct of the gases while at the same time providing a solution when the internal pressure becomes too high for the molded case of a circuit breaker.

In particular the invention relates to a circuit breaker with a housing for at least one separable contact pole-unit in which an arc extinguishing chamber can be fitted, or any other outer wall enabling said housing to be closed. The housing opens out from the circuit breaker case via at least two partitions provided with a rim on which the outer wall of the arc extinguishing chamber can rest. Preferably, in orthogonal cross-section, the housing presents a T-shape the branches of which T are formed by the rims.

The outer closing wall, which also forms the object of the invention, is of suitable shape to rest on the rims, with an end part that is protruding with respect to an intermediate part. The end part comprises the closing surface of the housing, advantageously a metal grate, and the intermediate part can enter into the housing. The transverse cross-section between the outer closing surface and the surface that is opposite thereto and advantageously parallel thereto, is preferably T-shaped, tolerating a clearance with the T of the housing, said clearance preferably being of increasing size between the intermediate part and the end part so as to allow a non-homogeneous gas flow in the space thus formed.

To enable differentiated tightness between the outer wall and the housing, the wall is associated with a valve device at the level of its opposite surface. The valve device comprises at least two lips protruding from the opposite surface at the level of the sides designed to be fitted on the rims of the housing. The lips are of sufficient size to rest on said rims and the valve device is advantageously of larger size than the outer surface of the wall which can be inscribed within the envelope defined by the lips. The valve device is advantageously made in a single piece and comprises a membrane in which at least one central passage hole is pierced interfitting with the grate, and a periphery having two opposite sides which form the lips whereas the other two sides act as sealing gasket.

The lips, or more generally the valve device, are made from insulating material, preferably a polymer, that is heat-resistant and resistant to sharp temperature increases, in particular to temperatures of more than 2000° C., or even 3500° C., for at least 5 ms, preferably at least 10 ms. To ensure tightness under normal conditions between the outer wall and the housing, the lips have a strength enabling the valve device to be kept substantially flat along the opposite surface and on the rims of the housing despite the overhang. The lips are such that no substantial strain is caused by a pressure orthogonal to the opposite surface that is lower than a first threshold, advantageously about 3 bars, even 7 and even up to 10 bars. When the pressure perpendicular to the lips exceeds a second threshold, for example 10 or 12 bars, a reversible deformation occurs. The strength is preferably such that, when the outer wall is placed on the rims of the housing and pressure is exerted from the bottom of the housing, the lip is lifted in uniform manner and comes up against the stop formed by the salient end part without any other deformation of the valve device. The overhang is advantageously sufficient for the lip to always be protruding with respect to the end part in the open position. Preferably at least the lips are made from aramide fibers which are very resistant to heat and flames, in particular from polyaramide with meta phenyl groups, in particular Nomex® 410.

The outer wall can form part of an arc extinguishing chamber, being orthogonal to a set of parallel arc separators with two securing side plates at the level of which the lips forming the valve are located. The width defined between the side plates is advantageously smaller than the width of the intermediate part so that the space between the housing and the outer wall is successively decreasing and increasing. The outer wall can also comprise a filtering system housed between the external grate and an internal frame which is inserted in the housing, the valve device forming a sealed gasket between the grate and frame.

To summarize, the invention relates to an outer wall of an arc extinguishing chamber designed to rest on two rims of a housing of a switchgear unit case, comprising a rigid grate closing the housing, the orthogonal to the closing surface of the housing cross-section of which comprises an end part that is able to rest on the rims salient with respect to an intermediate part that is able to be inserted in the space defined by said rims, and a device forming a valve coupled on the grate at the level of the intermediate part and salient on at least two sides by lips able to rest on said rims, wherein said lips of the device forming a valve are made from heat-resistant insulating material which has a strength such that the lip is substantially rigid and flat when it is subjected to an orthogonal pressure lower than a first threshold pressure, in particular 10 bars, and the lip deforms in reversible manner when the orthogonal pressure is greater than a second threshold pressure, in particular 10 bars. In particular, the lips are made from polyaramide able to withstand temperatures in excess of 2000° C. for at least 5 ms, in particular with separation of the amides by metaphenylene groups. The device forming a valve can comprise a unitary shield provided with at least one central passage hole, the two lips being on two opposite sides of the hole. The orthogonal cross-section of the grate can form a T-shape the branches of which are designed to rest on the rims and in which the lips of the device forming a valve are of a size such that an orthogonal pressure on said lips closes the space defined by the branches of said T-shape by a flat side.

The invention also relates to a switchgear unit comprising a case provided with at least one substantially rectangular parallelepipedic housing, at least two of the partitions of which open out from the case with a lip, at least one pole-unit with separable contacts in said housing, and an above-mentioned outer wall resting on the rims to close said housing. Alternatively, the switchgear unit can comprise a case provided with at least one substantially rectangular parallelepipedic housing, at least two of the partitions of which open out from the case with a lip, and an arc extinguishing chamber comprising the above-mentioned outer wall inserted in said housing resting on the rims.

BRIEF DESCRIPTION OF THE DRAWINGS

Other advantages and features will become more clearly apparent from the following description of particular embodiments of the invention given for non-restrictive example purposes only, represented in the appended drawings.

DETAILED DESCRIPTION OF A PREFERRED EMBODIMENT

Figure 1:
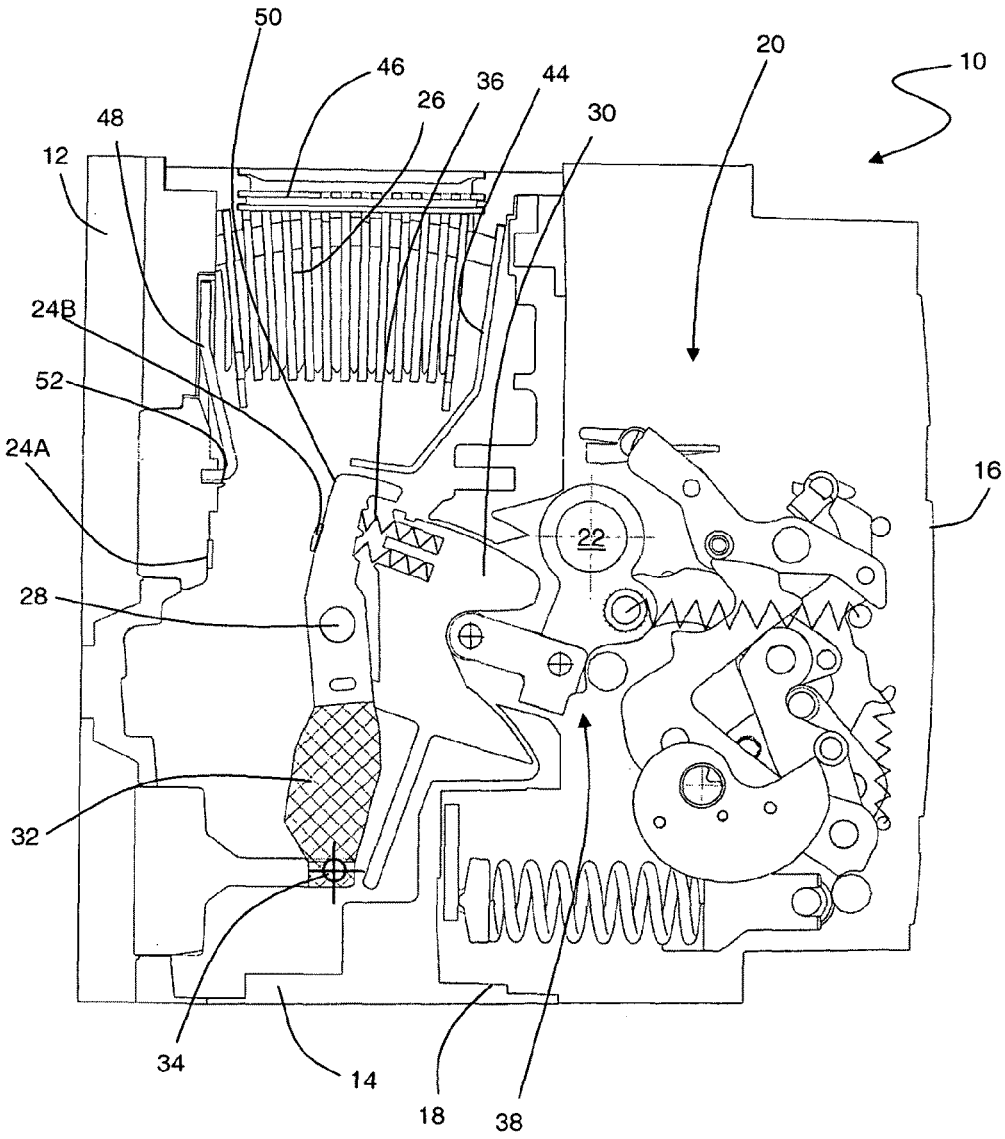
FIG. 1 shows a safety switchgear device with high electrodynamic withstand in which a system according to the invention can be fitted.

With reference to FIG. 1, a multipole circuit breaker 10 for high current intensities, in particular higher than 800 A, in conventional manner comprises, for each pole-unit, an insulating case formed by assembly of a base panel 12, an intermediate frame 14 with open ends and a front panel 16, which delineate a rear compartment and a front compartment on each side of a partition 18 of the intermediate frame 14. An operating mechanism 20 which acts on a switching shaft 22 common to the set of pole-units of the circuit breaker 10 is housed in a front compartment of the multipole circuit breaker 10. The rear compartment can be broken down into a plurality of elements each housing a pole-unit which comprises a separable contact device 24A, 24B and an arc extinguishing chamber 26.

The separable contact device comprises a stationary contact 24A directly supported by a first connecting strip (not shown) of the circuit breaker 10 passing through the base panel 12 of the insulating case, and a movable contact member 24B conventionally provided with a plurality of fingers provided with contact pads in parallel and fitted pivoting on a first transverse pivot-pin 28 of a support tunnel 30. The heel of each finger is connected to a second connecting strip (not shown) passing through the base panel 12 by means of a braid 32 made from conducting material. The connecting strips are designed to be connected to the line-side and load-side power system, for example via a set of busbars. The end of the tunnel 30 situated in proximity to the second connecting strip is equipped with a pin housed in a bearing securedly affixed to the insulating case so as to allow swivelling of the tunnel 30 between an open position and a closed position of the pole-unit (of the contacts 24A, 24B) around a geometric axis 34. A contact pressure spring device 36 is arranged in a recess of the tunnel 30 and biases the contact fingers 24B so that the latter swivel around the first pivot-pin 28. The tunnel 30 is coupled to the switching shaft 22 by a transmission rod/linkage assembly 38 in such a way that rotation of the shaft 22 results in swivelling of the tunnel 30 around the axis 34.

Figure 2:
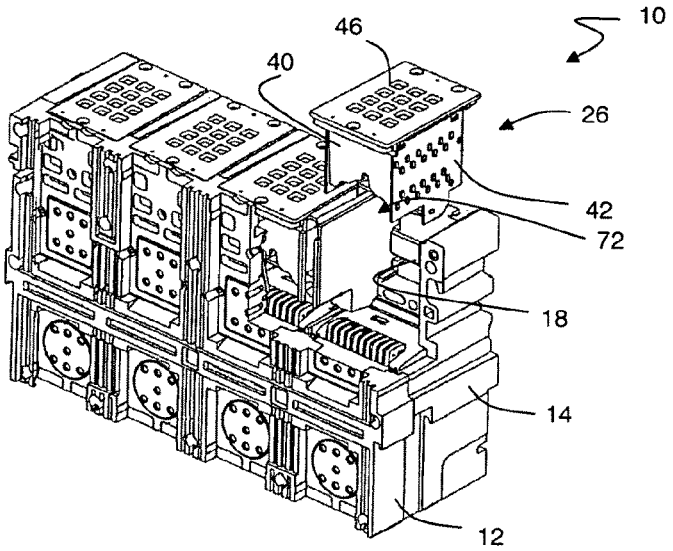
FIG. 2 illustrates assembly of an arc extinguishing chamber in a switching pole-unit.

Each contact device 24A, 24B is associated with an arc extinguishing chamber 26 which is inserted in one of the compartments of the circuit breaker 10. This construction, illustrated in FIG. 2, enables the state of the circuit breaker pole-units to be checked and the extinguishing chamber 26 to be replaced with a reduced number of handling operations.

Figure 3:
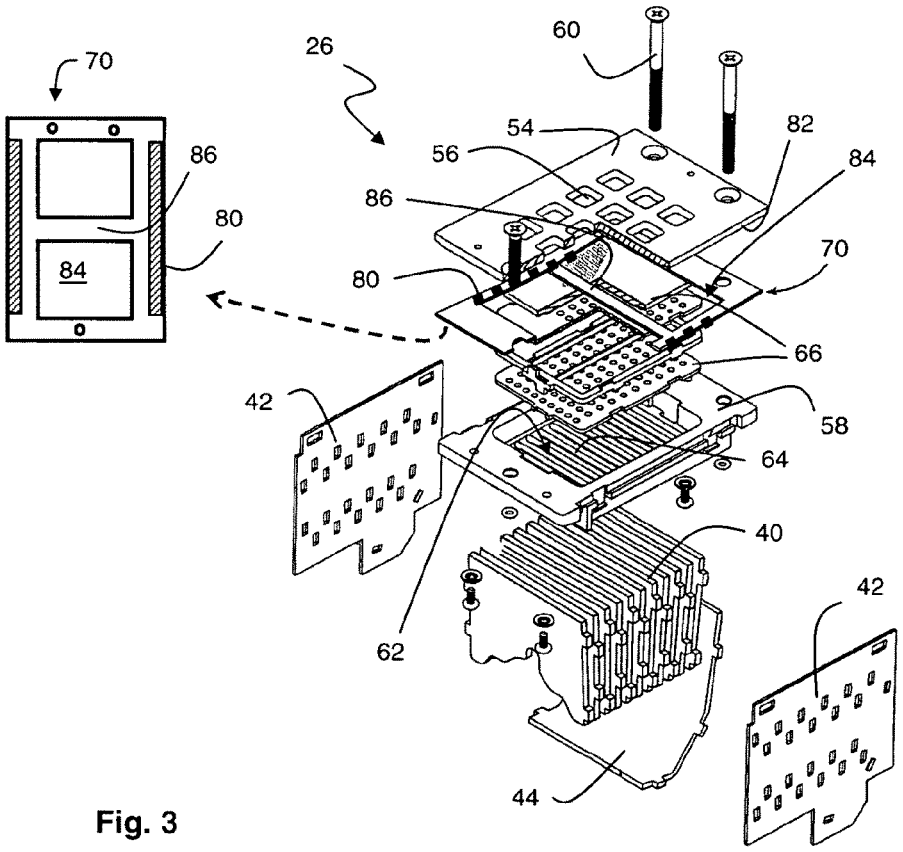
FIG. 3 represents an extinguishing chamber and a valve device according to a preferred embodiment of the invention.
Figure 4A:
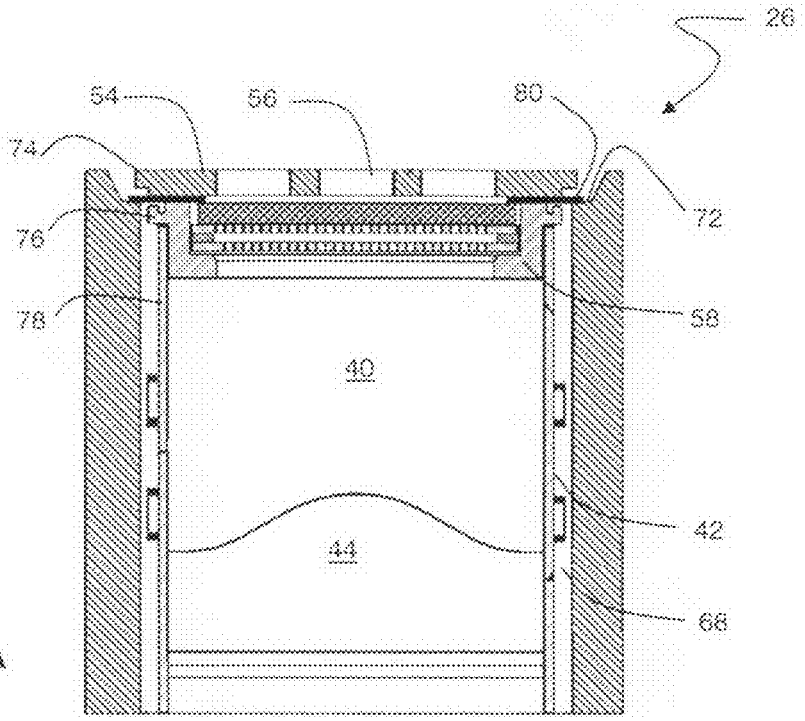
FIGS. 4A and 4B represent a system according to the invention in the case where the pressure is lower than the threshold and in the case where it is higher than the threshold.
Figure 4B:
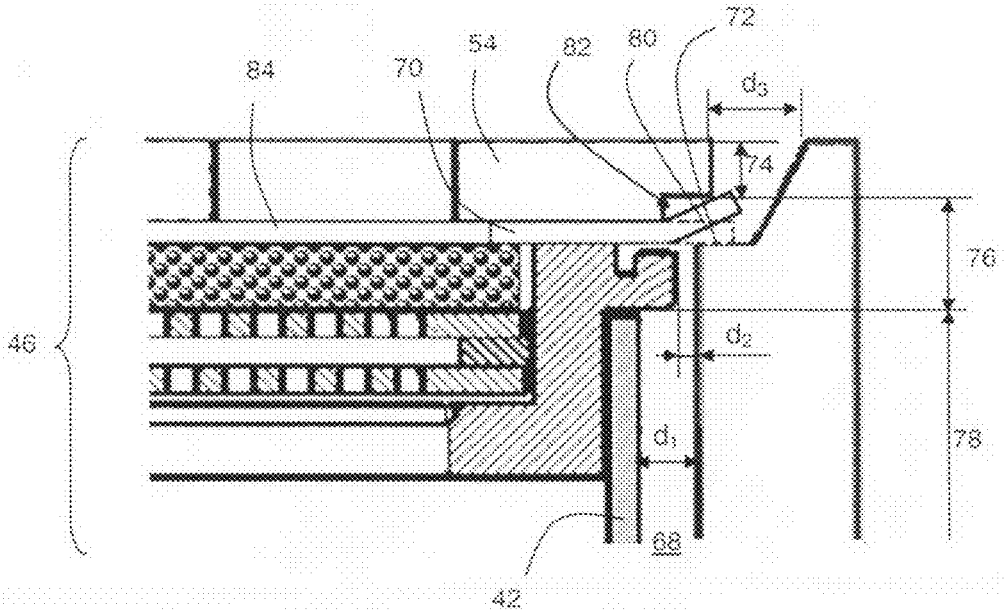

The structure of the arc extinguishing chamber, or arc chute, 26 can be seen more particularly in FIG. 3. The chamber 26 comprises a juxtaposition of separators formed by metal electric arc deionization plates 40. The separators 40 are assembled on an insulating support comprising two side plates, or cheeks, 42 the inner surface of which is provided with notches interfitting with complementary asperities of the plates 40. Positioning of the upper arcing horn 44 is performed in the same way, substantially parallel to the separators 40 and orthogonal to the side cheeks 42. An outer wall 46 is arranged substantially perpendicularly to the side plates 42 and to the deionization plates 40 and forms a framework for the assembly.

The arc extinguishing assembly is completed by a lower arc guiding horn 48 fixed to the base panel 12 and electrically connected to the stationary contact member 24A of the pole-unit, which delineates the entry to the extinguishing chamber 26. In the area directly facing the front end 50 of the movable contact 24B, the stationary contact 24A has a profiled edge 52 approximately complementary to the outline profile of the fingers 24B, ascending towards the protuberance of the bottom arcing horn 48 to globally ensure a profile without a marked interruption of slope with the latter, so as to eliminate risks of damage to the contact pads 24A, 24B. When opening of the contact members takes place, the initial swivelling movement of the tunnel 30 around its axis 34 does in fact cause pivoting of the movable contact fingers 24B around their pivot-pin 28 in the opposite direction, bringing the front part 50 of the contacts closer before separation of the contact pads takes place. The separating distance between the contacts 24A, 24B then increases more rapidly than the separating distance between the bottom arcing horn 48 and the movable contact 24*a*. The arc is initially drawn between the edges 50, 52 of the contacts and immediately migrates to a location between the protuberance of the horn 48 and the movable front part 50, preventing any movement of the arc towards the contact pads 24A, 24B. By further opening, the arc is extended in front of the chamber 26 and enters the latter in the usual way. The gases generated by the arc are thus in a first stage directed towards the extinguishing chamber 26 on which they impose an overpressure which can reach a value of more than 10 bars (respectively 14 bars) under extreme current breaking conditions for a circuit breaker having breaking performances of more than 100 kA rms, respectively about 200 kA, for a rated voltage of more than 400 V.

In circuit breakers of high-power range, the outer wall 46 forms a part of the wall of the case of the circuit breaker 10 and therefore enables the gases to be removed from the arc extinguishing chamber 26. For this purpose, the outer wall 46 is of composite structure with a stack of layers the external grate 54 of which comprises exhaust vents 56 for removal of the breaking gases. The external grate 54 can be made from the same material as the case 12, 14 of the circuit breaker 10, but, on account of pressure constraints, is preferably made from metal, for example steel with a thickness of 4 to 7 mm. The external grate 54 is associated with an internal frame 58 which is directly coupled with the side cheeks 42 of the extinguishing chamber 26, facing the separators 40. The internal frame 58 is made from a material suitable for its location, in particular from thermosetting polyester. The external grate 54 and internal frame 58 are secured to one another, for example by means of screws 60, three in the embodiment presented, to form a housing 62 designed to accommodate the elements performing filtering of the gases. The frame 58 is also provided with passage holes 64, advantageously in the form of slots and able to define an upper surface for the exhaust vents 56.

As is known, a filtering system 66 is fitted in the housing 62. In usual manner, the system 66 comprises a set of filters suitable for optimal limitation of pollution of the outside environment, for example a superposition of several shields including a porous shield comprising one or more superposed metal fabrics as described in FR 2 750 531, perforated diffuser shields made from insulating material (such as stratified thermosetting material), a metal grate, an insulating spacer, etc.

The outer wall 46, and more generally the arc extinguishing chamber 26, are assembled in the housing of the case in such a way that under "normal" operating conditions of the circuit breaker 10, for example from 2 to 50 kA, the assembly is hermetically tight (with the exception of the filtering system 56, 64, 66). In particular, when the internal pressure generated by the breaking gases is lower than a threshold, which can for example be fixed at 10 or 12 bars, the gas flow is directed into the means forming the filter 66 and flows from the slots 64 of the internal frame 58 to the vents 56 of the external grate 54, being decontaminated and cooled in the process.

In some cases, operation of the circuit breaker 10 generates exceptional conditions under which the pressure may exceed the previously set threshold. This can for example occur when the circuit breaker 10 has to meet a test under limit testing conditions corresponding to the most stringent standards. According to the invention, when the optimal operating threshold (10 or 12 bars in the above case) is exceeded, for example when breaking is performed with extreme performances, such as in excess of 100 kA rms, an additional opening is created so as to enable faster removal of the gases to outside the filtering system 66. The additional opening is only created temporarily during a very short time in which the pressure is maximum. This opening is further designed to maintain the removed gases at an acceptable temperature and to direct flow of the latter in controlled manner to prevent any possibility of arc-over onto the frame of the grounded equipment unit.

For this purpose, the invention takes advantage of the design of the circuit breaker 10, and in particular of the extinguishing chamber 26 being fitted (see FIG. 2) in an appropriate housing of the case. In particular, a residual clearance 68 exists between the assembly formed by the extinguishing chamber 26 and the partitions delineating the housing. The space 68 at the level of the side plates 42 is taken advantage of to form an alternative passage for the exhaust gases. To keep the tightly sealed assembly at a lower pressure than the threshold, a device forming a valve 70, designed to open in reversible manner when the pressure exceeds the threshold, is fitted to close off the space 68.

According to the invention, even when flow of the gases via the additional space 68 is possible, the gases are sufficiently cooled to prevent any risk of arc-over. For this purpose, a combination of four factors is preferably implemented:

- the duct 68 is suitable for a Venturi effect;
- the gas jet flows via a chicane system;
- the device forming a valve 70 is limited in movement;
- the device forming a valve 70 is "unstable" in the open position.

In particular, two at least of the partitions of the housing of the extinguishing chamber 26 in the usual manner comprise a rim 72 on which at least a part of the outer wall 46 of the extinguishing chamber 26 rests. The wall 46 thus comprises an end part 74 resting on the rims 72, an intermediate part 76 inscribed in the intermediate part 74 and in the surface defined by the rim 72, and an end part usually delineated by the side cheeks 42 and separators 40. The dimension of the duct 68 at the level of the side plates 42 is suitable for cooling, with creation of a Venturi effect. In particular, in cross-section orthogonal to the side cheeks 42, the distance between the partition of the housing and the extinguishing chamber 26 is about $d_1$=2.5 mm at the level of the end part 78, and is then reduced by 50% at least at the level of the intermediate part 76 to reach $d_2$=1 mm, and then increases again at the level of the end part 74. The space 68 advantageously increases continuously along the end part 74, with 2 mm≤$d_3$≤3 mm.

The device forming a valve 70 is fitted in the intermediate part 76 of the outer wall 46. It is in particular directly adjacent to the metal external grate 54 so as to come up against the stop formed by the end part 74 when opening and to thereby limit the gas flow via the duct 68. In parallel, the strength of the device forming a valve 70 is adjusted to ensure tightness at pressures below the threshold value.

The edge 80 of the device forming a valve 70 closing the duct 68 and coming up against the stop formed by the end part 74 of the grate 54 is designed to form the additional opening. According to a preferred embodiment of the invention, the edge 80 is of the spring-like lip type, i.e. the Venturi effect generates an oscillation of the lip 80 when gas flow takes place. To facilitate this movement, the edge 80 is overhanging on the rim 72 over a greater length than the end part 74. The end part 74 of the outer wall 46, in cross-section orthogonal to its surface, forms an L-shape 82 within the grate 54, and in the deformed position of the device forming a valve 70, the lip 80 remains substantially flat overshooting the L. The closing angle of the triangle 82 formed by the branches of the L, or angle of deflection of the lip 80 of the device forming a valve 70, is preferably about 30°.

To obtain the required criteria at least as far as its lips 80 are concerned, the device forming a valve 70 is made from insulating material of high strength but having a certain resilient flexibility, with a tensile strength of 500 to 900 N/cm (for a thickness of 0.8 mm), designed to withstand pressure (up to 14 bars) while remaining stable up to a first threshold (10 bars), temperature and a sharp increase of said temperature (4000° C. in 10 ms). In particular, a grey fiber of calendered insulating paper type with very good mechanical, dielectric and thermal strength or an amide polymer, of suitable thickness for a spring effect, can be used.

The device forming a valve 70 is advantageously made in a single piece and comprises a substantially rectangular shield corresponding to the outer surface of the grate 54 overshooting the latter by the two lips 80. The shield 70 is provided with at least one central passage hole 84. On the periphery of the hole 84, two of the edges form the lips 80 designed to seal off or open up the passage 68, and the other two edges act as sealing gasket between the grate 54 and the frame 58 of the outer wall 46, with the holes for the screws 60 in the illustrated embodiment. The passage hole 84 can correspond to a central hole of substantially the same size as the filtering system 66, but it is advantageous to provide strengtheners 86, in particular one or more strips passing right through the membrane 70 between the edges to define a plurality of holes. In the preferred embodiment illustrated, the shield 70 is provided with two holes 84 separated by a tab 86 of substantially the same width as the periphery. It is made from suitable aramide with a thickness of about 0.8 mm, for example a polyamide comprising metaphenylene groups, such as Nomex®, in particular Nomex® 410.

Thus, when the pressure is lower than a reference threshold, fixed according to the scheduled range of use of the circuit breaker 10, in particular 12 bars, the device forming a valve 70 remains closed. The gas flows through the filtering system 66 and the duct 68 between the case and the chamber 26 is sealed off by the lip 80 of the insulating shield 70. During the short time when the pressure exceeds the threshold, the device forming a valve 70 comes up against the stop formed by the grate 54 and the lip 80 opens at the level of the rim 82. An additional opening enables the gas to outflow, in parallel to the main filtering system 66, so long as the pressure is sufficient to keep this duct 68 open. The gas flux exiting via this additional opening is not however direct and remains controlled in flowrate and temperature. Controlled limitation in the movement of the shield 70 regulated by the stop against a steel grate 54, the movement causing a Venturi effect imposed on the gases by the chicane system and by the local tapering of the upstream cross-section in the duct 68, and the oscillation of the lip 80 of the valve 70 are sufficient to maintain the global temperature below an acceptable level, estimated at between 1500° C. and 3000° C., to prevent any arc-over onto the frame of the circuit breaker 10. Once the pressure has dropped back below the threshold value, the device forming a valve 70 recloses so as to limit outflow of non-filtered gas as far as possible.

The solution according to the invention thereby avoids a large extra cost in so far as the ruggedness of the enclosure of the circuit breaker 10 is concerned. The case is designed for breaking in normal operation, in particular 10 or 12 bars for a 100 kA circuit breaker, for which it remains hermetically tight. When events occur resulting in these thresholds being exceeded, the device enables the gases to be removed quickly so as prevent explosion, without increasing the thickness of the panels of the case and/or modifying their material. Furthermore, on account of the additional opening provided, having to fit means for enhancing the ruggedness and tightness can be circumvented. The solution according to the invention can moreover be easily fitted on circuit breakers 10 already in operation. The arc extinguishing chambers 26 of the circuit breakers 10 are conventionally inserted in inner housings of the case (FIG. 2), and it is possible to modify the chambers 26, or even only their outer wall 46, to provide an already installed circuit breaker 10 with the advantages provided by the device 70 according to the invention.

Although the invention has been described with reference to a multipole circuit breaker 10 from the range having breaking capacities comprised between 100 kA and 200 kA for a rated voltage of more than 400 V and a current rating of 1000 to 6300 A, with a theoretical breaking pressure of 12 bars, it is in no way limited thereto. Other elements may be concerned by the invention. In particular, switchgear units with lesser performances can take full advantage of the solution according to the invention, and the number of pole-units of the circuit breakers concerned is indifferent. It is further possible to use the device forming a valve 70 according to the invention for switchgear units whose arc extinguishing chambers 26 are entirely fitted in cases, their outer wall 46 opening out onto a moulded plastic wall into a removal duct, or for circuit breakers 10 not comprising a filtering system 66.

The invention claimed is:

1. An outer wall of an arc extinguishing chamber, for resting on two rims of a housing of the case of a switchgear unit, said outer wall comprising an external rigid grate for closing off said housing, said grate comprising an intermediate part and an end part for resting on said rims and for protruding from the intermediate part into a space defined between said wall and said rims, a valve device coupled to the grate at the level of the intermediate part, including lips protruding from the intermediate part on at least two sides for resting on said rims, wherein said lips are heat-resistant insulating material having a strength such that each lip is substantially rigid and flat when said lip is subjected to an orthogonal pressure lower than a first threshold pressure, and said lip is deformable in reversible manner when the orthogonal pressure is greater than a second threshold pressure; and an internal frame and a filtering system housed between the internal frame and the external grate, the valve device for forming a tight gasket between said frame and said grate, wherein a cross-section of the wall forms a T-shape the branches of which are for resting on said rims, and wherein the lips are of such a size that an orthogonal pressure on said lips will close a space defined where the branches of said T approach a flat side of said housing.

2. The outer wall according to claim 1 wherein the second threshold pressure is 10 bars and the first threshold pressure is lower than 10 bars.

3. The outer wall according to claim 1 wherein the valve device comprises a unitary shield having at least one central passage hole, the two lips being on two opposite sides of the hole.

4. The outer wall according to claim 1 wherein the lips are made from polyaramide withstanding temperatures of more than 2000° C. for at least 5 ms.

5. The outer wall according to claim 4 wherein the lips are made from polyamide, amides of which are separated by metaphenylene groups.

6. The outer wall according to claim 1 wherein the second threshold pressure is 10 bars and the first threshold pressure is lower than 10 bars, wherein the lips are made from polyamide, amides of which are separated by metaphenylene groups, and wherein the valve device comprises a unitary shield having at least one central passage hole, the two lips being on two opposite sides of the hole.

7. The outer wall according to claim 2 wherein the lips are made from polyaramide withstanding temperatures of more than 2000° C. for at least 5 ms.

8. An arc extinguishing chamber comprising a set of parallel arc separators, two side plates securing the separators, and an outer wall according to claim 1 orthogonal to the side plates and to the separators, the lips of the valve device being located along the side plates.

9. An arc extinguishing chamber according to claim 8 wherein the second threshold pressure is 10 bars and the first threshold pressure is lower than 10 bars and wherein the lips are made from polyaramide withstanding temperatures of more than 2000° C. for at least 5 ms.

10. An arc extinguishing chamber to claim 9 wherein the valve device comprises a unitary shield having at least one central passage hole, the two lips being on two opposite sides of the hole, and the lips are made from polyamide, amides of which are separated by metaphenylene groups.

11. A switchgear unit comprising a case provided with at least one substantially rectangular parallelepipedic housing, comprising at least two of partitions which open out from the case with a rim, at least one separable contact pole-unit in said housing, and an outer wall according to claim 1 resting on the rims to close said housing.

12. A switchgear unit comprising a case comprising at least one substantially rectangular parallelepipedic housing, comprising at least two partitions which open out from the case with a rim, and an arc extinguishing chamber according to claim 8 in said housing resting on the rims.

13. The outer wall according to claim 1 wherein the second threshold pressure is 10 to 12 bars, and the first threshold pressure is lower than the second threshold pressure.

14. The arc extinguishing chamber according to claim 8 wherein the second threshold pressure is 10 to 12 bars, and the first threshold pressure is lower than the second threshold pressure.

15. An arc extinguishing chamber comprising a set of parallel arc separators, two side plates securing the separators, and an outer wall orthogonal to the side plates and to the separators, said outer wall for resting on two rims of a housing of a case of a switchgear unit, wherein the outer wall comprises:

an external rigid grate for closing off the housing, said grate comprising an intermediate part and a T-shape having branches for resting on the rims and a central portion for insertion into a space defined by said rims; an internal frame and a filtering system housed between the internal frame and the external grate, a valve device for forming a tight gasket between said frame and said grate, coupled to the grate at the level of the intermediate part and lips protruding from the intermediate part on at least two sides for resting on said rims and along the side plates, wherein said lips are heat-resistant insulating material having a strength such that each lip is substantially rigid and flat when said lip is subjected to an orthogonal pressure lower than a first threshold pressure, and said lip is deformable in reversible manner when the orthogonal pressure is greater than a second threshold pressure, wherein the lips are of such a size that an orthogonal pressure on said lips will close a space defined between the grate and a flat side of the housing.

16. The arc extinguishing chamber according to claim 15 wherein the lips are made from polyamide withstanding temperatures of more than 2000° C. for at least 5 ms, amides of which are separated by metaphenylene.

17. A switchgear unit comprising a case having at least one substantially rectangular parallelepipedic housing which comprises two partitions each of which opens out from the case with a rim, and an arc extinguishing chamber, and which comprises: a rigid grate for closing off the housing by resting on two rims of the housing, an intermediate part of the rigid grate being in a space defined by said rims; and a valve device coupled to the grate at the level of the intermediate part and lips protruding from the intermediate part on at least two sides for resting on said rims, wherein said lips are heat-resistant insulating material having a strength such that each lip is substantially rigid and flat when said lip is subjected to an orthogonal pressure lower than a first threshold pressure, and said lip is deformable in reversible manner when the orthogonal pressure is greater than a second threshold pressure; and an internal frame and a filtering system housed between the internal frame and the external grate, the valve device for forming a tight gasket between said frame and said grate, wherein a cross-section of the wall forms a T-shape the branches of which are for resting on the rims, and wherein the lips are of such a size that an orthogonal pressure on said lips will close a space defined between the grate and a flat side of said housing.

18. The switchgear unit according to claim 17 wherein the second threshold pressure is 10 bars and the first threshold pressure is lower than 10 bars, wherein the lips are polyaramide withstanding temperatures of more than 2000° C. for at least 5 ms, the device forming a valve comprises a unitary shield provided with at least one central passage hole, the two lips being on two opposite sides of the hole.

19. The arc extinguishing chamber according to claim 15 wherein the second threshold pressure is 10 to 12 bars, and the first threshold pressure is lower than the second threshold pressure.

20. The switchgear unit according to claim 17 wherein the second threshold pressure is 10 to 12 bars, and the first threshold pressure is lower than the second threshold pressure.

* * * * *